US007196291B2

(12) United States Patent
Cothran

(10) Patent No.: US 7,196,291 B2
(45) Date of Patent: Mar. 27, 2007

(54) FOOD OVEN

(76) Inventor: Herman Cothran, 8635 W. Sahara, Apt. 515, Las Vegas, NV (US) 89117

( * ) Notice: Subject to any disclaimer, the term of this patent is extended or adjusted under 35 U.S.C. 154(b) by 306 days.

(21) Appl. No.: 10/944,371

(22) Filed: Sep. 17, 2004

(65) Prior Publication Data

US 2006/0060186 A1 Mar. 23, 2006

(51) Int. Cl.
*A21B 1/14* (2006.01)
*A21B 1/22* (2006.01)
*A21B 3/04* (2006.01)

(52) U.S. Cl. ..... 219/394; 219/393; 219/398; 219/400; 219/402; 219/412; 99/482

(58) Field of Classification Search ..... None
See application file for complete search history.

(56) References Cited

U.S. PATENT DOCUMENTS 1,901,616 A 3/1933 Vaughan
3,002,444 A * 10/1961 Hoebing ..... 99/482
3,173,357 A 3/1965 Nunnery
3,397,632 A 8/1968 Moler
4,130,052 A 12/1978 Jacobson
4,232,597 A 11/1980 Perrine
4,355,570 A 10/1982 Martin
4,474,107 A * 10/1984 Cothran ..... 99/482
4,669,447 A * 6/1987 Kelly ..... 126/21 A
4,852,544 A * 8/1989 Williams et al. ..... 126/19 R
4,854,949 A * 8/1989 Giles et al. ..... 99/403
4,902,316 A * 2/1990 Giles et al. ..... 99/403
5,801,362 A * 9/1998 Pearlman et al. ..... 219/400
6,333,492 B1 * 12/2001 Graves et al. ..... 219/413
6,362,459 B1 * 3/2002 Schmidt ..... 219/414

* cited by examiner

*Primary Examiner*—Joseph Pelham
(74) *Attorney, Agent, or Firm*—Stetina Brunda Garred & Brucker

(57) ABSTRACT

An improved food oven apparatus and related methods for preparing food utilizing digitally controlled heating elements and a smoker unit. User-operable controls in communication with a digital controller allow for independent control of the heating elements and the smoker unit. One or more electric fans can be provided for reducing condensation from forming within a control unit of the food oven. A heating element connection assembly can also be provided for reducing stress exerted on the heating elements caused by the repeated expansion and contraction of the compartment. The food oven can also be provided with an air cleaning apparatus configured to perform a multi-stage cleaning process, thereby eliminating the need for a separate fixed hood system.

10 Claims, 4 Drawing Sheets

FOOD OVEN

CROSS-REFERENCE TO RELATED APPLICATIONS

U.S. Pat. No. 4,474,107 is incorporated by reference herein.

STATEMENT RE: FEDERALLY SPONSORED RESEARCH/DEVELOPMENT

Not Applicable

BACKGROUND OF THE INVENTION

With the rise of the number of prepared meals being served to the general public through food service establishments including restaurants, supermarkets, and convenience stores, there is a need for food service establishments to be able to prepare food in a convenient, efficient manner. Unfortunately, many of the existing ovens utilized by food service establishments fail to meet these needs.

Many existing ovens employ analog control circuitry which often provides only limited amounts of control over the various cooking operations that a user of the oven may desire to perform. In addition, the repeated expansion and contraction of oven compartments in conventional ovens can cause undue stress on the various heating elements employed therein.

Moreover, many existing ovens require the use of expensive permanent exhaust hoods, fire suppression systems, or both. Such requirements can substantially increase the installation costs as well as the operation costs of existing ovens. The mobility of existing ovens can also be severely limited by their attachment to permanent fixtures. Such ovens can limit the number and types of properties that prospective entrepreneurs may consider when choosing to establish a restaurant or other food preparation enterprise. As the cost of commercial real estate increases, retail food sites that are designed to facilitate permanent oven installations can be increasingly difficult to afford.

Thus, there exists a substantial need in the art for an improved food oven apparatus which can be utilized to prepare food while avoiding one or more of the drawbacks associated with existing ovens.

BRIEF SUMMARY OF THE INVENTION

The present invention, roughly described, relates to an improved oven apparatus and related methods for preparing food utilizing digitally controlled heating elements and a smoker unit. In one embodiment, a food oven apparatus is provided comprising a housing having one or more oven compartments therein. A support member is positionable within the compartment for holding food to be prepared. First and second heating elements for heating the compartment can be disposed within the compartment on first and second sides of the support member. A smoker unit can also be disposed within the compartment for generating smoke within the compartment. A digital controller can be provided which is in communication with the first and second heating elements and the smoker unit. User-operable controls in communication with the digital controller can also be provided for independently controlling each of the first and second heating elements and the smoker unit in response to user operation of the controls.

In various embodiments, the digital controller can be disposed within a control unit positioned on a top surface of the housing. The user-operable controls can be positioned so as to be accessible from a front panel of the control unit. One or more electric fans can also be disposed within the control unit for passing air out of the control unit through one or more vents positioned on exterior surfaces of the control unit.

In another embodiment, one or more of the heating elements can be implemented with a heating element connection assembly in order to reduce stress exerted on the heating elements caused by the repeated expansion and contraction of the compartment during cooking cycles.

In yet another embodiment, the food oven can be provided with an air cleaning apparatus configured to perform a multi-stage cleaning process. For example, the air cleaning apparatus can be implemented to include a mesh filter, an electrostatic precipitator, and a charcoal filter. Exhaust air that is processed by the air cleaning apparatus can be released to the exterior of the food oven, thereby eliminating the need for a separate fixed hood system.

These as well as other embodiments contemplated by the present invention will be more fully set forth in the detailed description below and the figures submitted herewith.

DETAILED DESCRIPTION OF THE INVENTION

Figure 1:
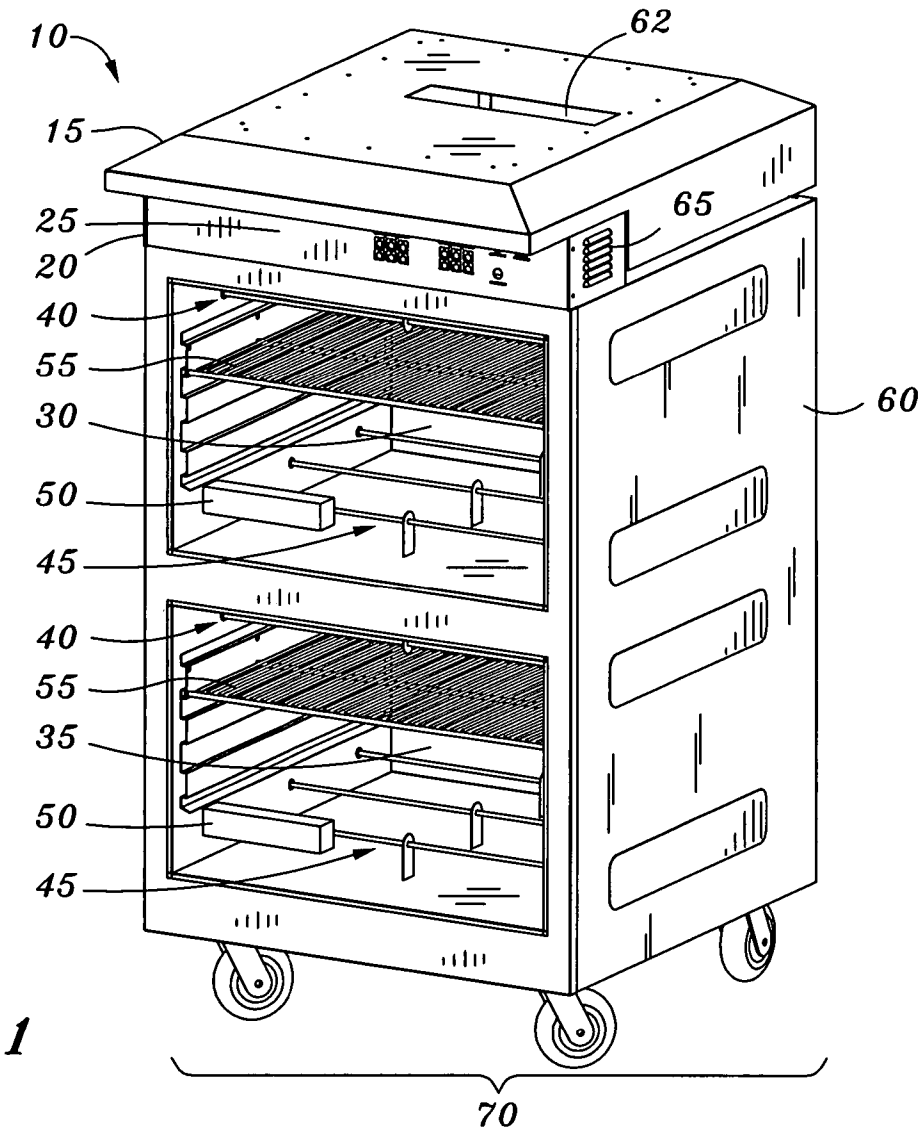
FIG. 1 is a front perspective view of a food oven apparatus in accordance with an embodiment of the present invention.
Figure 3:
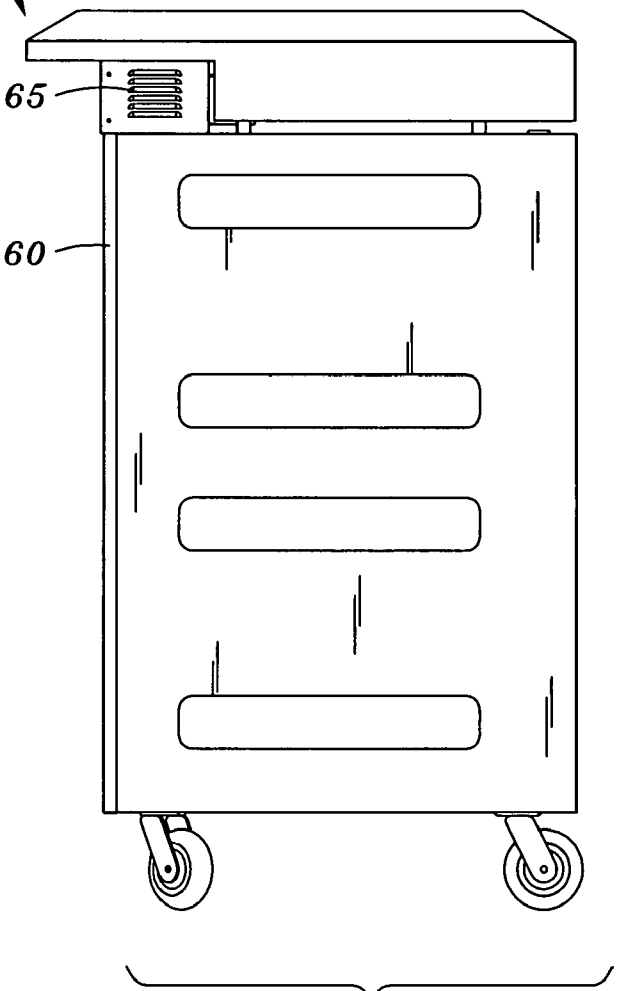
FIG. 3 is a side view of a food oven apparatus in accordance with an embodiment of the present invention.
Figure 2:
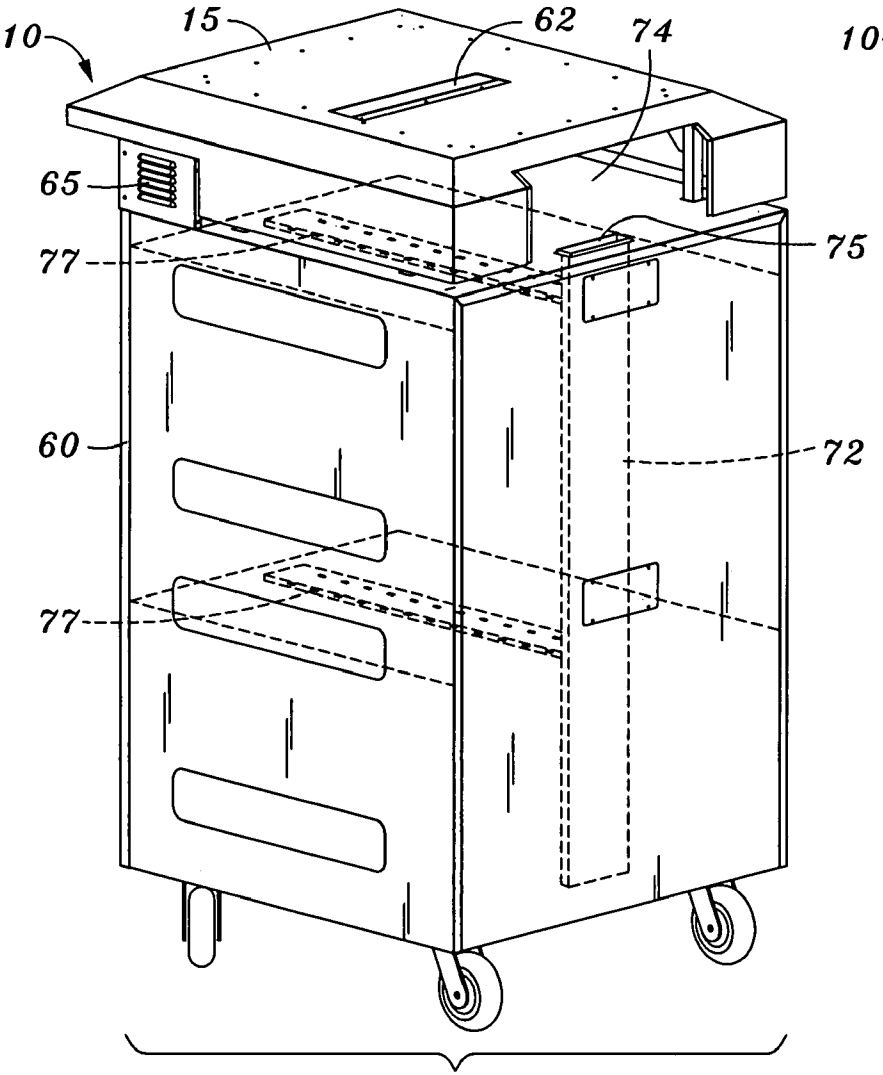
FIG. 2 is a rear perspective view of a food oven apparatus in accordance with an embodiment of the present invention.

Referring to the front, rear, and side views of FIGS. 1, 2, and 3, respectively, there is shown an improved food oven apparatus 10 in accordance with an embodiment of the present invention. As illustrated, apparatus 10 comprises a housing 60 mounted on casters 70 for facilitating convenient transport of the apparatus 10. A vent shroud 15 with an exhaust aperture 62 can be mounted on an upper surface of the housing 60.

In various embodiments, the housing 60 can be formed of double wall stainless steel, with the space existing between the double wall construction of the housing 60 being filled with suitable thermal insulation (not shown) to reduce heat loss from the interior of the housing 60 to the environment. In one, embodiment, the thermal insulation is implemented with Insulfrax Thermal Insulation compliant with UL732 (ASTM E-84) and (Directive 97/69EC), permitting operating temperatures up to approximately 1832 degrees Fahrenheit. In various embodiments, housing 60, vent shroud 15, compartments 30 and 35, and/or other internal and external components of apparatus 10 can be formed of stainless steel.

As illustrated, housing 60 can be segregated into separate upper and lower oven compartments 30 and 35, respectively, which may be independently controlled to effectuate differing cooking applications within the apparatus 10. The oven compartments 30 and 35 can be provided with front access door(s) (not shown) which may be mounted in accordance with various installation methods known in the art. Support members such as slidable grates 55 are provided for each of the compartments 30 and 35 for receiving and holding food products to be prepared using the apparatus 10. As shown in FIG. 1, the grates 55 can be positioned at a plurality of levels within each of the compartments 30 and 35. The lower portion of each of the compartments 30 and 35 can include one or more slide out trays (not shown) that serve as a pan or reservoir for grease and juices released from food disposed within the compartments 30 and 35 during operation.

Each of the oven compartments 30 and 35 is provided with upper and lower arrays 40 and 45 of heating elements. As illustrated in FIG. 1, arrays 40 and 45 are disposed on opposite sides of the grates 55 of each oven compartment. In one embodiment, each of the arrays 40 and 45 comprise a plurality of infrared stainless steel heating rods which extend transversely across the width of the compartments 30 and 35. Such infrared heating rods can be obtained from a variety of manufacturers and are advantageous due to their ability to rapidly reach high operating temperatures and subsequently sustain the operating temperature at relatively low input power requirements. Due to the orientation of the upper and lower heating element arrays 40 and 45 in relation to the grates 55, the upper arrays 40 can serve a broiling function while the lower arrays 45 can serve a baking function. In addition, with both the upper and lower arrays 40 and 45 of an oven compartment being operated concurrently, food positioned upon the grates 55 can be in effect barbecued within the oven compartment.

The lowermost portion of each of the compartments 30 and 35 is further provided with a smoker unit 50. In various embodiments, the smoker unit 50 can comprise a generally U-shaped infrared heating element (not shown) which is rigidly mounted to the sidewall of the housing 60 by an insulator block (not shown). The lateral distance between the elongate members of the U-shaped heating element is preferably sized to be slightly less than the dimensions of a hickory wood block (not shown) such that the block may be cradled within the U-shaped heating element. A generally L-shaped shroud (not shown) can be removably mounted to the insulator block to prevent grease and other juices released from the food being prepared from contacting and vaporizing upon the heating element. As will be recognized, in operation, as the heating element of the smoker unit 50 reaches operating temperatures, the hickory wood block will slowly burn, releasing natural hickory smoke which travels through each of the compartments 30 and 35.

An electronic control unit 20 can be positioned/mounted on top of the housing 60 and below vent shroud 15. The front panel 25 of the electronic control unit 20 provides convenient access to digital controls for operating the apparatus 10. Electric fans can be incorporated within control unit 20 to provide ventilation of the control unit 20 and to prevent condensation from forming within control unit 20. Air passed by the electric fans can be blown out of the control unit 20 through vents 65 positioned on opposite sides of the exterior side surfaces of the control unit 20.

The operation of the heating arrays 40 and 45 and smoker units 50 within each of the compartments 30 and 35 can be monitored and/or independently controlled by the electronic control unit 20, thereby permitting independent baking, broiling, barbecuing, smoking, and/or hold-warming of foods disposed within each of the compartments 30 and 35.

In operation, a food product desired to be prepared, can be inserted upon one or both of the grates 55 and disposed within the oven compartments 30 and/or 35. Access doors (not shown) are then closed, and the desired food preparation process for each of the compartments 30 and 35 can be selected using controls provided on front panel 25.

It will be appreciated that apparatus 10 can be implemented to provide convectional air flow in compartments 30 and 35. Air can be drawn into the compartments 30 and 35 through apertures (not shown) below the access doors and/or other appropriate portions of apparatus 10. Such air can be drawn through natural convection without the use of fans. As air within compartments 30 and 35 is heated, natural convection can occur within the compartments. Exhaust air can be drawn up through a plurality of convection apertures 77 in the top of each of the compartments 30 and 35, and drawn through chimney 72 where it is exhausted out of exhaust vent 75 (see FIG. 3). In various embodiments, the convection apertures 77, chimney 72, and exhaust vent 75 can be implemented to provide independent exhaustion of exhaust air from each of compartments 30 and 35.

It will be appreciated that a conventional fixed exhaust hood can be connected to exhaust vent 75. However, in another aspect of the present invention, the exhaust air can be cleaned prior to exhaustion in accordance with a multi-stage cleaning process provided by an air cleaning apparatus disposed within a cavity 74 formed between housing 60 and vent shroud 15. As a result, the apparatus 10 can be installed in any convenient location without the need for a separate fixed hood system.

Figure 4:
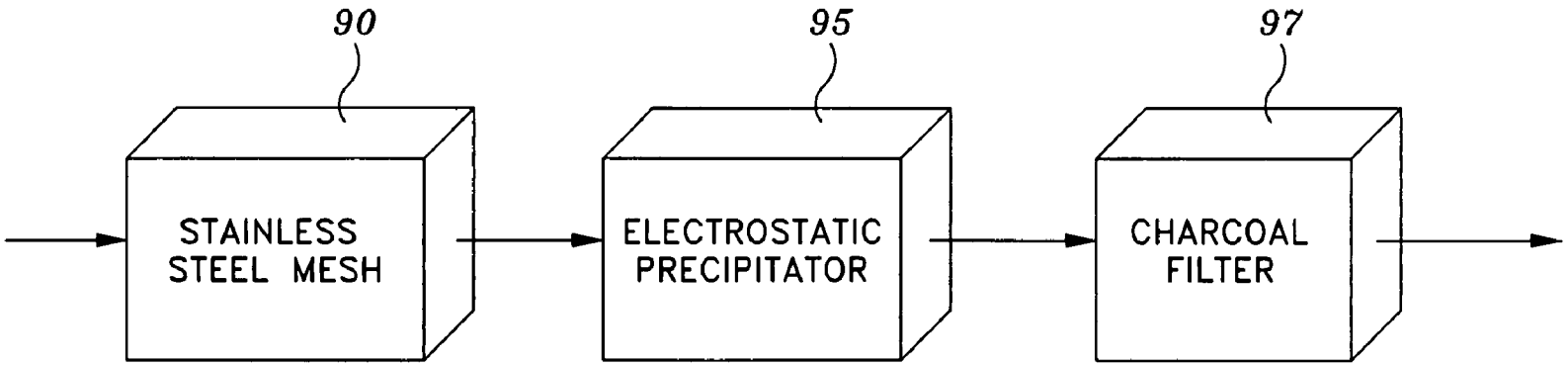
FIG. 4 is a block diagram representation of a multi-stage process for cleaning air provided by an air cleaning apparatus in accordance with an embodiment of the present invention.

FIG. 4 is a block diagram representation of a multi-stage process for cleaning air provided by an air cleaning apparatus of the food oven apparatus 10 in accordance with an embodiment of the present invention. Exhaust air received from exhaust vent 75 can be passed through a stainless steel mesh filter 90 designed to remove grease particles. After passing through the mesh filter 90, the air can be passed through an electrostatic precipitator 95 that electronically charges the passing air, thereby attracting grease and smoke particles to further clean the air. Thereafter, the air can be passed through a charcoal filter 97 for removing odors from the air. The exhaust air can then be passed through the exhaust aperture 62 in vent shroud 15 to the exterior of the apparatus 10. In one embodiment, the air cleaning process displaces approximately 300 cubic feet of air per minute and therefore does not require make-up air.

It will be appreciated that as the temperature within oven compartments 30 and 35 rises and falls during cooking cycles, the compartments can expand and contract. In another aspect of the present invention, one or more of the heating elements of arrays 40, 45, and/or smoker unit 50 can be implemented to compensate for expansion and contraction of the oven compartments 30 and 35 during cooking cycles.

Figure 5:
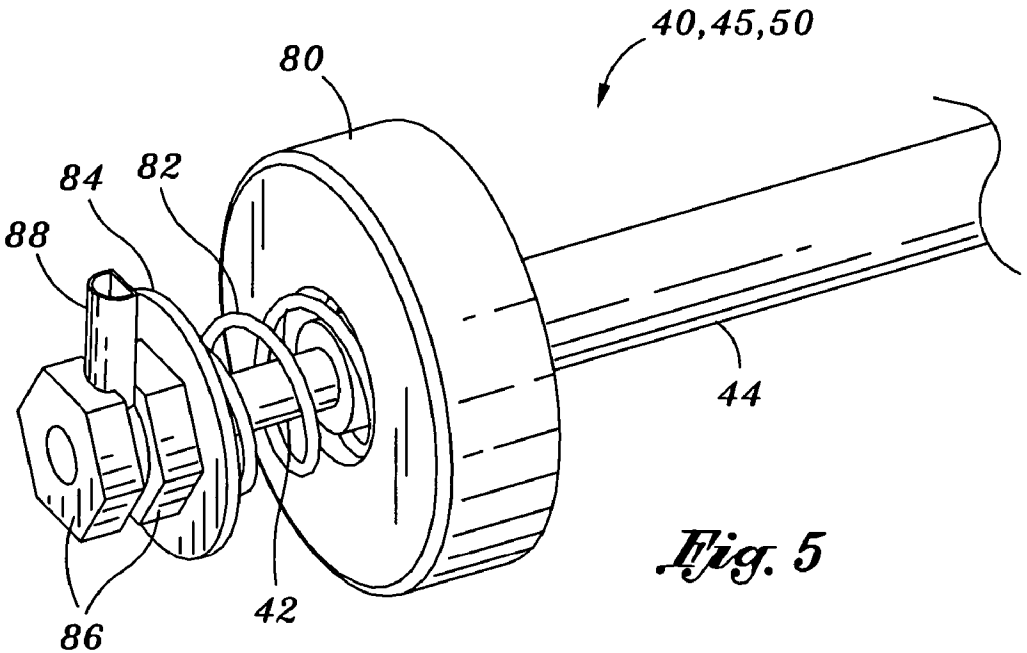
FIG. 5 is a perspective view of a heating element connection assembly of a food oven apparatus in accordance with an embodiment of the present invention.

FIG. 5 is a perspective view of a heating element connection assembly of a food oven apparatus 10 in accordance with an embodiment of the present invention. As illustrated in FIG. 5, a heating element of one of the arrays 40, 45, and/or smoker unit 50 can comprise a rod 42 substantially encapsulated by a steel sheath 44. A spacer 80, spring 82, washer 84, and hex nuts 86 can engage the end portion of the heating element, and can be mounted within the double wall housing 60 of the apparatus, with the heating element extending through the housing 60 into the oven compartment 30 and/or 35 through an aperture in the oven compartment (i.e., the interior wall of the double wall housing 60). Electric wires (not shown) for powering the heating element can be passed through conduit 88 to control unit 20. Spacer 80 can be constructed of ceramic material and mounted so as to engage the interior wall of the double wall housing 60 (the wall of the oven compartment). Washer 82 can be mounted so as to engage the outside wall of the double wall housing 60. Spring 82 can be mounted so as to springably engage the spacer 80 and washer 82.

As the compartment expands during a cooking cycle, spacer 80 can move with the compartment, causing the spring 82 to compress. Similarly, as the compartment contracts, the spacer 80 can continue to move with the compartment, causing the spring 82 to decompress. It will be appreciated that by installing the heating elements of arrays 40 and 45 in the manner illustrated in FIG. 5, the stress exerted on the heating elements can be reduced during cooking cycles. As a result, the likelihood of electrical failure of one or more of the heating elements due to electrical shorts stemming from repeated expansion and contraction can be reduced and/or eliminated.

Figure 6:
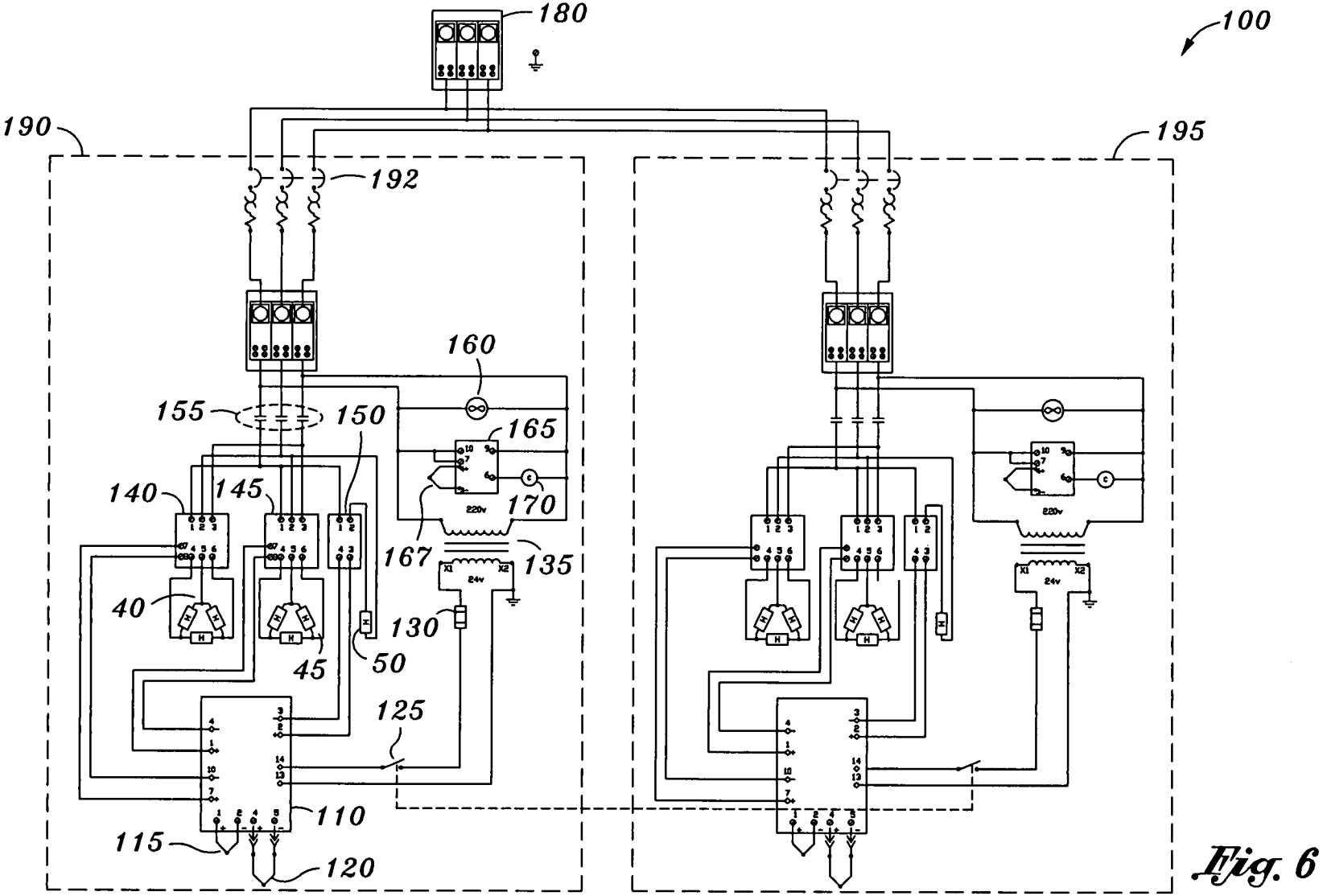
FIG. 6 is a schematic representation of an electrical control circuit of an electronic control unit of a food oven apparatus in accordance with an embodiment of the present invention.

FIG. 6 is a schematic representation of an electrical control circuit 100 of the electronic control unit 20 of apparatus 10 in accordance with an embodiment of the present invention. As will be recognized, the circuit 100 is composed of two branches 190 and 195 (indicated by phantom lines) which serve to control the operation of the upper and lower oven compartments 30 and 35, respectively. Because the two branches can be implemented in the same manner, only branch 190 will be described. However, it will be appreciated that the description provided in relation to branch 190 can be applied to branch 195 as well.

Electrical power is provided to the circuit 100 by a source 180 of approximately 240-volt triple phase AC current. However, it will be appreciated that other voltages are contemplated, including but not limited to approximately 220 volts, approximately 230 volts, and others. As illustrated, the electrical power is distributed to the various components of branch 190 through circuit breakers 192. A digital controller 110 operating at 24-volts is powered through transformer 135 and fuse 130. A user-operable power switch 125 is provided for switching the digital controller 110 on and off, thereby switching the apparatus 10 on and off as well. User-operable controls located on the front panel 25 of the electronic control unit 20 (see FIG. 1) can be implemented to interface with digital controller 110, thereby allowing users to control the operation of apparatus 10. In one embodiment, the digital controller 110 can be implemented as a MiniChef™ 2000 controller or a Series N7 cooking computer (part no. N7MF-1060-03XX), both available from Watlow Electric Manufacturing Company.

Digital controller 110 is in communication with an oven thermocouple 115 for detecting the temperature of compartment 30, and is also in communication with a heat probe thermocouple 120 for detecting the temperature measured by an optional heat probe. It is contemplated that these and/or other probes can also be used to monitor/measure cooking times of the apparatus 10. In various embodiments, digital controller 110 can also provide functionality for recording data pertaining to a cooking cycle (for example, time, temperature, etc.). In various embodiments, digital controller 110 can also provide functionality for maintaining compatibility with a protocol of the National Association of Foodservice Equipment Manufacturers (NAFEM) and/or the Hazard Analysis Critical Control Point (HACCP) food safety program for recording cook times and temperatures for food safety purposes.

As illustrated, digital controller 110 is further in communication with heating arrays 40 and 45 through solid state power controllers 140 and 145 that operate the heating arrays. Digital controller 110 is also in communication with smoker unit 50 through solid state relay 150 that operates the heating element of the smoker unit 50.

A fan 160 mounted at one end of control box 20 (behind vents 65) is also powered by source 180. A high temperature limit controller 165 and thermocouple 167 are also provided in branch 190 of circuit 100. In one embodiment, thermocouple 167 is disposed within chimney 72. In operation, if thermocouple 167 indicates that a high temperature limit has been reached (for example, approximately 600 degrees Fahrenheit), then contactor 170 can be caused to open, thereby interrupting electrical power through contacts 155. As a result, electrical power supplied to smoker unit 50 as well as heating arrays 40 and 45 will be disrupted. In one embodiment, the limit controller 165 can be implemented as a Series LF limit controller available from Watlow Electric Manufacturing Company.

It will be appreciated from the schematic representation 100 of FIG. 6 that the smoker unit 50 as well as heating arrays 40 and 45 of oven compartment 30 can be independently controlled by way of the communication between digital controller 110 and components 140, 145, and 150. By operating the controls accessible on front panel 25 of the control unit 20, a user can instruct the digital controller 110 to cause the apparatus 10 to independently perform any number of functions desirable for food preparation in upper compartment 30. As discussed, such functions can include baking, broiling, barbecuing, smoking, and/or hold-warming of foods disposed within compartment 30. It will be appreciated that the same operations and functionality can be provided in relation to the lower compartment 35 through appropriate components of apparatus 10.

It will be appreciated that the scope of the present invention is not limited by the particular embodiments set forth herein. Other appropriate variations, whether explicitly provided for or implied, are contemplated by the present disclosure. It is contemplated that any of the various components described herein can be combined and/or separated into other configurations where appropriate. It is further contemplated that the ordering of various steps described herein can be changed where appropriate to achieve the functionality provided by the present invention. Similarly, individual steps can be combined and/or dissected into fewer or greater numbers of steps where appropriate to provide the functionality described herein.

What is claimed is:

1. A food oven apparatus comprising:

a housing having a first oven compartment therein;

a first support member positionable within the first compartment for holding food to be prepared within the first compartment;

a vent shroud mounted on a top surface of the housing;

a first heating element disposed within the first compartment for heating the first compartment, the first heating element is positioned on a first side of the first support member;

a second heating element disposed within the first compartment for heating the first compartment, the second heating element is positioned on a second side of the support member;

the heating elements configured to adjust and allow relative movement between the heating elements and the first compartment to accomodate thermal expansion and contraction of the first compartment;

a first smoker unit disposed within the first compartment for generating smoke within the first compartment;

a first digital controller in communication with the first and second heating elements and the first smoker unit; and a first set of user-operable controls in communication with the first digital controller for independently controlling each of the first and second heating elements and the first smoker unit in response to user operation of the first set of controls.

2. The food oven apparatus of claim 1, further comprising:

a control unit positioned on a top surface of the housing, the digital controller is disposed within the control unit, the user-operable controls are accessible from a front panel of the control unit.

3. The food oven apparatus of claim 2, further comprising:

a vent positioned on an exterior surface of the control unit;

an electric fan disposed within the control unit for passing air out of the control unit through the vent.

4. The food oven apparatus of claim 1, the first digital controller providing functionality for recording a cooking cycle.

5. The food oven apparatus of claim 1, the first digital controller is compatible with a NAFEM protocol.

6. The food oven apparatus of claim 1, further comprising:

a probe in communication with the first digital controller for monitoring cooking temperatures of the food to be prepared within the first compartment.

7. The food oven apparatus of claim 1, the housing is formed of a stainless steel material.

8. The food oven apparatus of claim 1, the housing is a double wall housing, the apparatus further comprising:

an aperture in an interior wall of the housing, at least one of the heating elements passing through the aperture;

a spacer engaging the at least one of the heating elements and the interior wall of the housing;

a washer engaging the at least one of the heating elements and an exterior wall of the housing; and a spring engaging the spacer and washer, the spring is configured to compress and decompress in response to expansion and contraction of the first compartment.

9. The food oven apparatus of claim 1, further comprising:

a cavity defined by the top surface of the housing and the vent shroud;

an exhaust vent in the top surface of the housing;

a convection aperture in the first compartment for receiving exhaust air from the first compartment;

a chimney disposed between the convection aperture and the exhaust vent, the chimney configured to receive the exhaust air from the convection aperture and pass the exhaust air to the exhaust vent;

an air cleaning apparatus disposed within the cavity, the air cleaning apparatus comprising:

a mesh filter for receiving the exhaust air from the exhaust vent, an electrostatic precipitator for receiving the exhaust air from the mesh filter, and a charcoal filter for receiving the exhaust air from the electrostatic precipitator; and an exhaust aperture in a top surface of the vent shroud for receiving the exhaust air from the charcoal filter and passing the exhaust air to an exterior of the food oven apparatus.

10. The food oven apparatus of claim 1, further comprising:

a second oven compartment within the housing;

a second support member positionable within the second compartment for holding food to be prepared within the second compartment;

a third heating element disposed within the second compartment for heating the second compartment, the third heating element is positioned on a first side of the second support member;

a fourth heating element disposed within the second compartment for heating the second compartment, the fourth heating element is positioned on a second side of the second support member;

a smoker unit disposed within the second compartment for generating smoke within the second compartment;

a second digital controller in communication with the third and fourth heating elements and the second smoker unit; and a second set of user-operable controls in communication with the second digital controller for independently controlling each of the third and fourth heating elements and the second smoker unit in response to user operation of the second set of controls.

* * * * *